United States Patent [19]

Simon

[11] 4,263,737

[45] Apr. 28, 1981

[54] ILLUMINATED GRID DISPLAY WITH PRIMARY AND SECONDARY COPY

[75] Inventor: Virgil S. Simon, Glenview, Ill.

[73] Assignee: Thomas A. Schutz Co., Inc., Morton Grove, Ill.

[21] Appl. No.: 137,481

[22] Filed: Apr. 4, 1980

[51] Int. Cl.[3] ..... G09F 19/14

[52] U.S. Cl. ..... 40/453; 40/437; 40/577

[58] Field of Search ..... 40/453, 437, 454, 476, 40/577, 160

[56] References Cited

U.S. PATENT DOCUMENTS

| | | | |
|---|---|---|---|
| Re. 13,109 | 5/1910 | Spiegel | 40/437 |
| 829,492 | 8/1906 | Spiegel | 40/453 |
| 1,867,051 | 7/1932 | Bareis | 40/453 X |
| 2,221,888 | 11/1940 | White | 40/437 X |
| 2,355,902 | 8/1944 | Berg | 40/453 |
| 2,374,371 | 4/1945 | Morch | 40/437 |
| 2,918,743 | 12/1959 | Swarbick | 40/453 X |
| 3,205,598 | 9/1965 | Grosse | 40/453 X |
| 3,484,969 | 12/1969 | Newland | 40/437 |
| 3,811,213 | 5/1974 | Eaves | 40/437 |
| 3,918,185 | 11/1975 | Hasala | 40/437 |

*Primary Examiner*—John F. Pitrelli

*Attorney, Agent, or Firm*—Wegner, Stellman, McCord, Wood and Dalton

[57] ABSTRACT

A point of purchase advertising display device has a front element and a rear element which are spaced a short distance apart and back illuminated. Primary copy is transparent or translucent on the front element and is repeated on the rear element in translucent form in register with that on the front element. A front fine pattern of transparent and opaque areas occupies the rest of the front element and defines the margins of each character in the primary copy. Translucent secondary copy on the rear element is viewed through parts of the front pattern, and the rest of the rear element consists of a rear fine pattern of translucent and opaque areas which is dissimilar from the front pattern but cooperates with the front pattern to produce a field of changing visual effects as a person moves relative to the display device. The rear fine pattern defines the margins of each character in the copy on the rear element. The appearance of the secondary copy changes clearly but subtly as the visual effects of the field change.

15 Claims, 6 Drawing Figures

ILLUMINATED GRID DISPLAY WITH PRIMARY AND SECONDARY COPY

BACKGROUND OF THE INVENTION

The principal purpose of point of purchase advertising display devices is to attract the attention of customers who are in the immediate vicinity so that they notice the name of the advertised product while having a favorable response to the appearance of the display device. At the same time, the device must be sufficiently inexpensive that a manufacturer or distributor of a product can buy the device in large quantities for use wherever his product is sold. For certain applications, such as the front of a vending machine, the device must be quite thin.

A common type of point of purchase advertising display device attracts attention by changing visual effects; and such changing visual effects may be produced in a number of different ways. A well known way to produce such changing visual effects is to use two cooperating sheets, one behind the other, with the forward sheet provided with a pattern that causes it to act as a shutter, exposing or concealing different parts of the rear sheet as the position of the front sheet changes relative to the line of sight from a viewer's eye to the rear sheet.

Devices of the foregoing general type are disclosed in Spiegel U.S. Pat. Nos. 829,492 and 911,561 (Re. 13,109); Morch U.S. Pat. No. 2,374,371; Newland U.S. Pat. No. 3,484,969; and Hasala U.S. Pat. No. 3,918,185. As shown by the two Spiegel patents, it is well known to produce the shift of the front sheet relative to a viewer's line of sight either by moving one of the two sheets or by fixing the two sheets a predetermined distance apart so that as a viewer moves relative to the display device his line of sight to the rear sheet is through different parts of the front sheet which therefore occupies different positions relative to the line of sight.

As shown by the above identified prior art, it is known to produce changing visual effects by providing a front sheet, or screen, which has parallel transparent and opaque strips, with a rear sheet, or screen, having contrasting strips that present one appearance if viewed from one angle and a different appearance if viewed from another angle. The present inventor has heretofore used this principle to produce a display device having brightly rear illuminated copy surrounded by a shifting field.

Morch U.S. Pat. No. 2,374,371 shows a way to utilize the techniques taught by the Spiegel patents to cause parts of a display to look as though they are moving.

SUMMARY OF THE INVENTION

The present invention utilizes the basic techniques of the above identified prior art to produce novel and unique visual effects in a point of purchase advertising display device which has primary copy and secondary copy.

The device includes a front element of substantial size which has a front fine pattern of transparent and opaque areas, and primary copy on the front element which is transparent or translucent and occupies only a small part of the element. The front pattern occupies all of the front element except for what is occupied by the primary copy, and thus defines the margins of the primary copy. A rear element has a rear fine pattern of visually contrasting areas which is dissimilar from the front fine pattern and which cooperates with the front pattern to produce changing visual effects when the front pattern occupies different positions relative to a line of sight from a viewer's eye to the rear pattern. The primary copy is repeated on the rear element effectively in register with the primary copy on the front element, and there is also secondary copy on the rear element which is viewed through parts of the front pattern. The primary and secondary copy on the rear element contrasts visually with the rear pattern, and the margins of all such copy are defined by the rear pattern. Finally, there are means operatively associated with the front and rear elements to provide for a change in the position occupied by the first pattern relative to a line of sight from a viewer's eye to the second pattern.

As is known from the prior art, the device of the invention may be so constructed that the means operatively associated with the front and rear elements consists of means to fixedly position the elements a predetermined distance apart; and for simplicity and low cost that is the preferred structure of the present device.

Furthermore, in order to assure adequate visibility of the secondary copy and the changing visual effects in a brightly lighted location, it is preferred that the device be rear illuminated, which means that it utilizes opaque and translucent areas to provide the visually contrasting areas of the rear fine pattern, and the primary and secondary copy on the rear element is translucent.

An advertising display device embodying the present invention presents highly visible primary copy surrounded by a field which attracts a viewer's attention by the changing visual effects which occur in it; and at the same time the secondary copy is seen in muted form, and the shapes of the letters in the secondary copy appear to change clearly but subtly due to changes in the appearance of the immediately surrounding and margin defining portions of the field.

Variations in the front fine pattern and the rear fine pattern selected for a particular display device produce widely varying kinds of changing visual effects.

THE DRAWINGS

DETAILED DESCRIPTION

Figure 1:
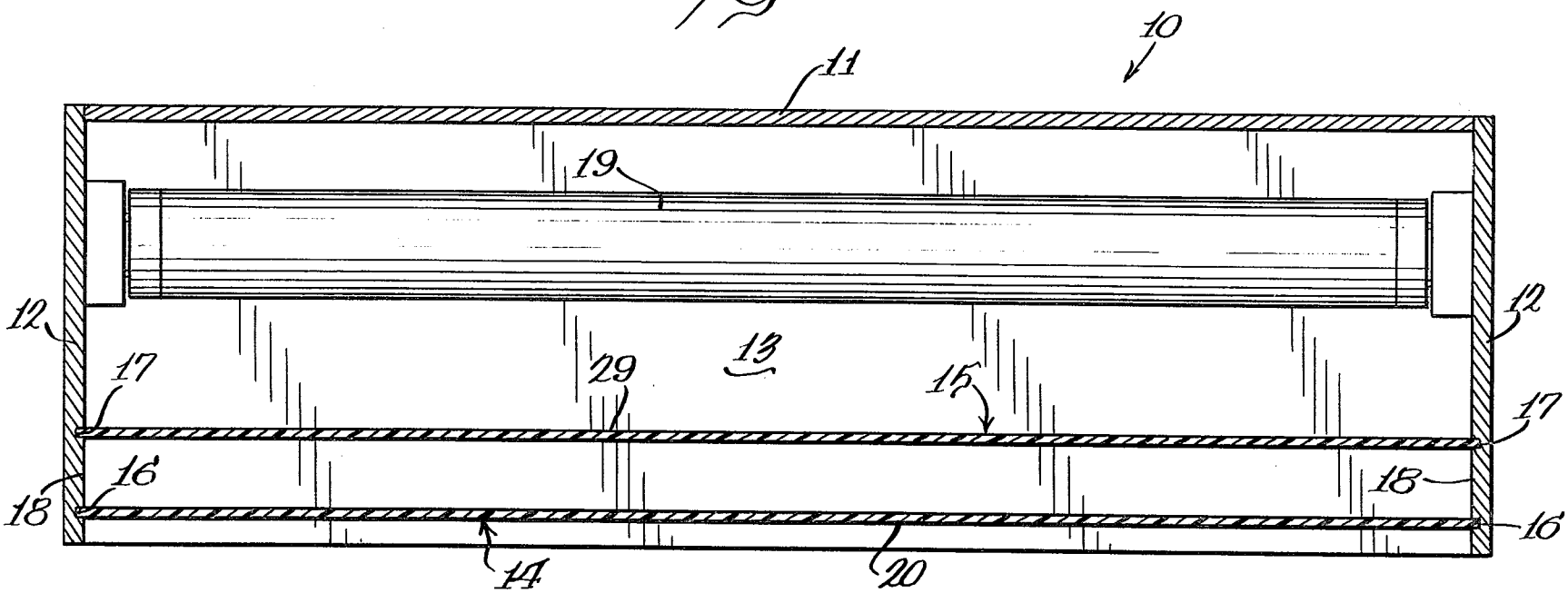
FIG. 1 is a horizontal sectional view of a device embodying the invention.

Referring to the drawings in detail, and referring first to FIG. 1, the device of the present invention consists of a box-like housing, indicated generally at 10, which includes a rear wall 11, end walls 12, a bottom wall 13, and a top wall (not shown). The front of the housing is open, and in the front of the housing are a front display element, indicated generally at 14, and a rear display element, indicated generally at 15, which is a predetermined distance to the rear of the front display element. Front slots 16 andrear slots 17 in the end walls 12 receive the end portions of the respective front and rear display elements so that the slots and the parts 18 of the end walls between the slots provide means fixedly positioning the front and rear display elements at said predetermined distance apart. Additional slots (not shown) in the bottom wall 13 receive the lower marginal portions of the front and rear display elements; and the top of the housing is similarly slotted to receive the upper marginal portions of said display elements. Suitable illuminating means, illustrated in FIG. 1 as a fluorescent lamp 19, is located in the housing 10 behind the rear display element 15. In practice, of course, the illuminating means will consist of whatever number of fluorescent lamps is necessary to achieve reasonably uniform illumination of the entire rear display element.

Figure 2:
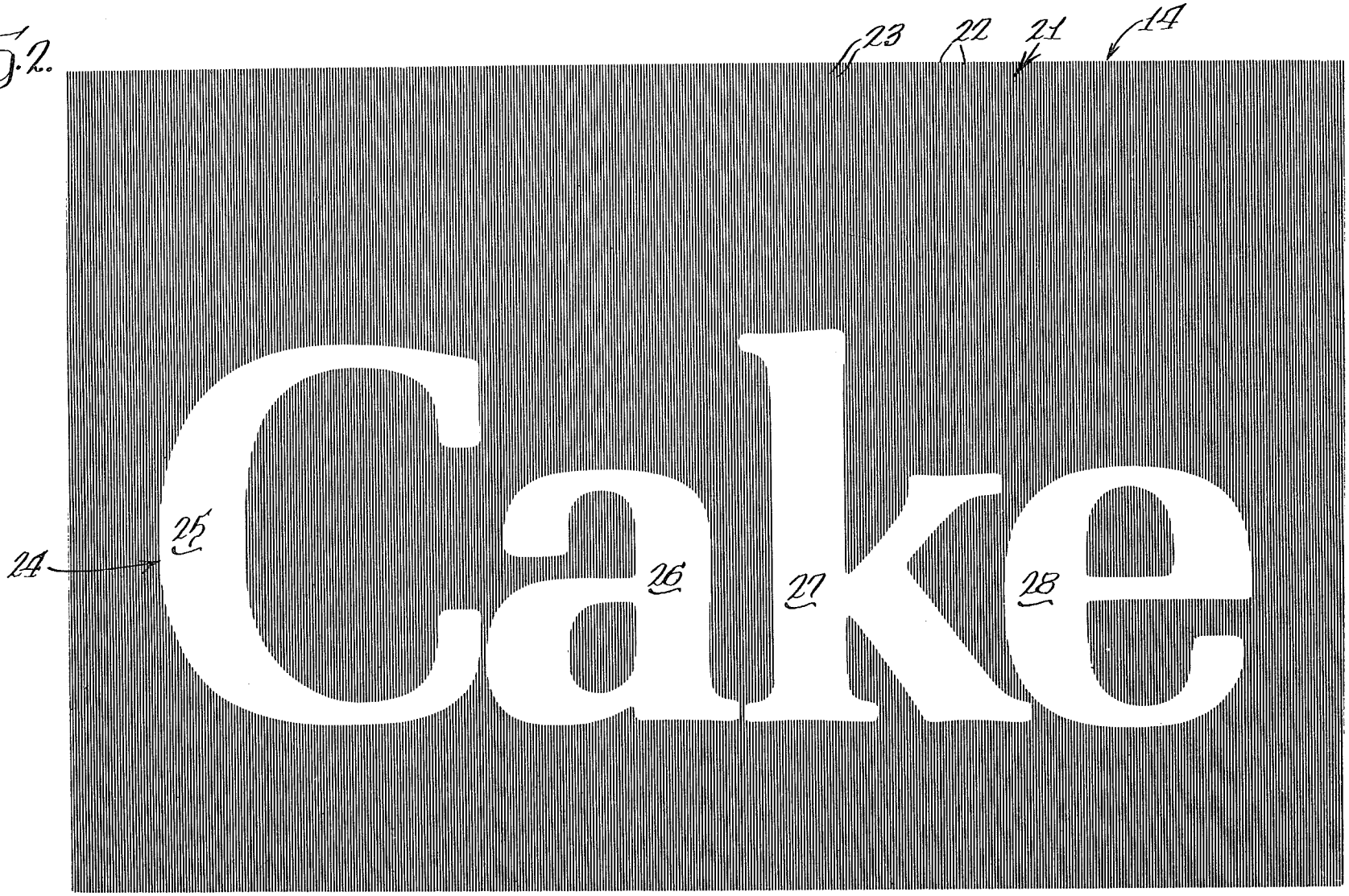
FIG. 2 is a front elevational view of the front element which is used with either a first or a second embodiment of the invention.

Referring now particularly to FIGS. 1 and 2, the front display element 14 comprises a rigid transparent or translucent panel 20 which is received in the slots 16 in the end walls 12, and a front pattern 21 is intimately associated with the front panel, preferably by printing it directly upon a face of said panel; or it may be printed upon a separate transparent film which is adhered directly to a face of the front panel. The pattern 21 consists of transparent areas 22 and opaque areas 23 which, in the illustrated embodiment, are vertical parallel lines. Primary copy, indicated generally at 24, consists of several characters such, for example, as the characters 25–28; and all the characters of the primary copy are transparent or translucent and have their margins defined by the opaque areas 23 of the front pattern 21. The transparent strips 22 and the opaque strips 23 are of a predetermined width which, in a typical commercial embodiment of the invention, is about 1/32 inch.

Figure 3:
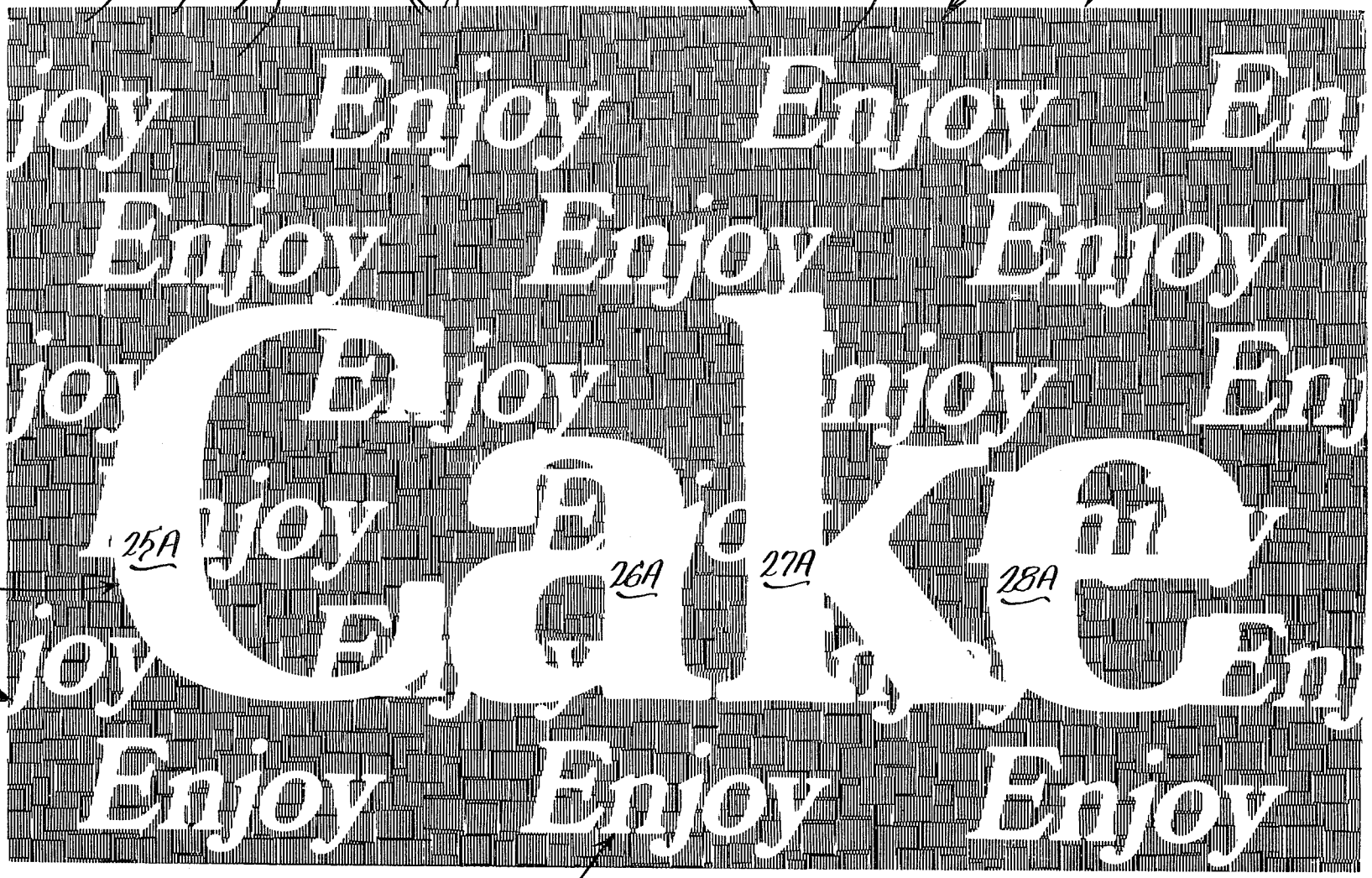
FIG. 3 is a front elevational view of a rear element for a first embodiment of the invention.

Referring now to FIGS. 1 and 3, the rear element 15 comprises a rear panel 29 which carries a rear pattern of visually contrasting areas, indicated generally at 30, which is dissimilar from the front pattern 21. In the embodiment of FIG. 3, the rear pattern 30 consists of a multiplicity of rectangular zones of different sizes and shapes, such as the zones 31, 32 and 33 in FIG. 3. Each of the zones consists of narrow, visually contrasting strips such as the white strip 34 and the black strip 35. Each of the visually contrasting strips is of substantially the same width as the predetermined width of the front pattern strips 22 and 23. Additionally, some of the rectangular zones, such as the zone 36, are vertical so that their contrasting strips are parallel to the strips 22 and 23; while others, like the zone 37, are at a very slight angle relative to the vertical strips of the front pattern 21.

The primary copy 24 is repeated upon the rear display element 15, as indicated generally at 24A in FIG. 3; and each character 25A, 26A, 27A and 28A of the repetition of the primary copy is effectively in alignment with the corresponding character on the front element.

In addition to the primary copy repeated upon the rear element 15, there is secondary copy, indicated generally at 38. The secondary copy is seen to be scattered throughout the area of the rear pattern 30, and the margins of all the characters of the secondary copy 38 are defined by the rear pattern 30 except for a few which run into the primary copy.

Figure 4:
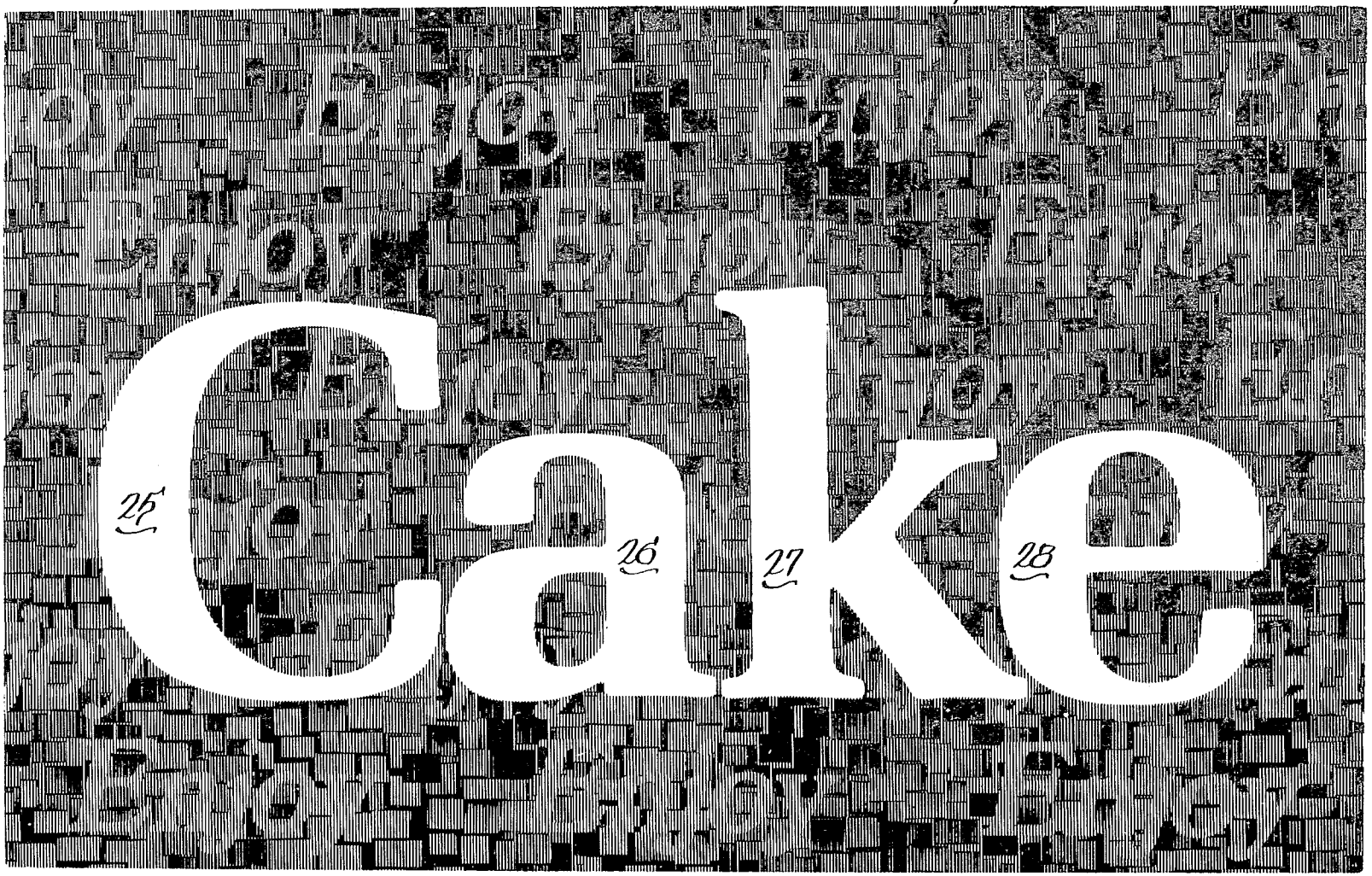
FIG. 4 is a front elevational view of the superimposed front and rear elements of said first embodiment of the invention.

Referring now to FIG. 4, when the rear display element 15 is positioned behind the front display element 14 the characters 25–28 of the primary copy are highly visible, and are surrounded by a field, indicated generally at 39, which presents a substantially different appearance either from the front pattern 21 or the rear pattern 30; and at the same time the secondary copy 38 is seen in muted form through the front pattern 21.

As previously indicated, the preferred embodiment of the invention is rear illuminated, so the primary and secondary copy on the rear display element 15 is translucent, as are the white strips 34 within the rectangular zones of the rear pattern 30. The primary copy is brilliantly illuminated, and because of the spacing between the front element 14 and the rear element 15 the appearance of the field 39, and the shapes of the letters forming the secondary copy, change as a viewer moves relative to the display device. Some of the rectangular zones are seen in FIG. 4 to be completely blacked out because the opaque strips 23 of the front pattern 21 are in register with the transparent strips 34 of the zones; while in other cases the zones appear the same as they do if they are not seen through the front element. The changes produce a flickering effect of the zones which have vertical opaque and translucent strips 34 and 35, while the zones such as the zone 37 which are inclined, seem to fade in and out from top to bottom or vice versa. The constant changes in the visual appearance of the rectangular zones immediately surrounding the letters of the secondary copy cause clear but subtle changes in the shape of the letters forming the secondary copy as a viewer moves relative to the display.

The speed with which the changes in appearance of the field 39 occur within a given degree of movement of an observer can be adjusted by changing the distance between the front and rear display elements, while maintaining the same predetermined width for the strips of the front pattern 21 and the rear pattern 30. The greater the space between the front and rear display elements, the more rapid is the change in appearance of the field 39 in relation to the amount the viewer moves. With the strips of the front and rear patterns about 1/32 inch wide, a space between elements of about ½ inch to 1 inch seems to produce a desirable rate of change in the appearance of the field.

The relation of the size of the pattern strips to each other and to the spacing between the panels can be varied to give a broad choice of motion effects. Very fine patterns may be used to give a moire effect in addition to the basic visual motion described. Very bold patterns may be used in large size applications or for the graphic effect.

The rear pattern 30 is printed by any means possible to provide an illuminated panel with the darker pattern strips printed in opaque or very dense translucent color. The remaining background color within the pattern strip zone and also the secondary copy is printed with a lighter translucent color, leaving the primary copy area to be a visually contrasting color, such as translucent white.

The front pattern 21 is printed on the rear or front surface of a transparent clear panel with opaque or very dense translucent color. The primary letter areas may be left transparent, or printed with a contrasting color such as translucent white.

Figure 5:
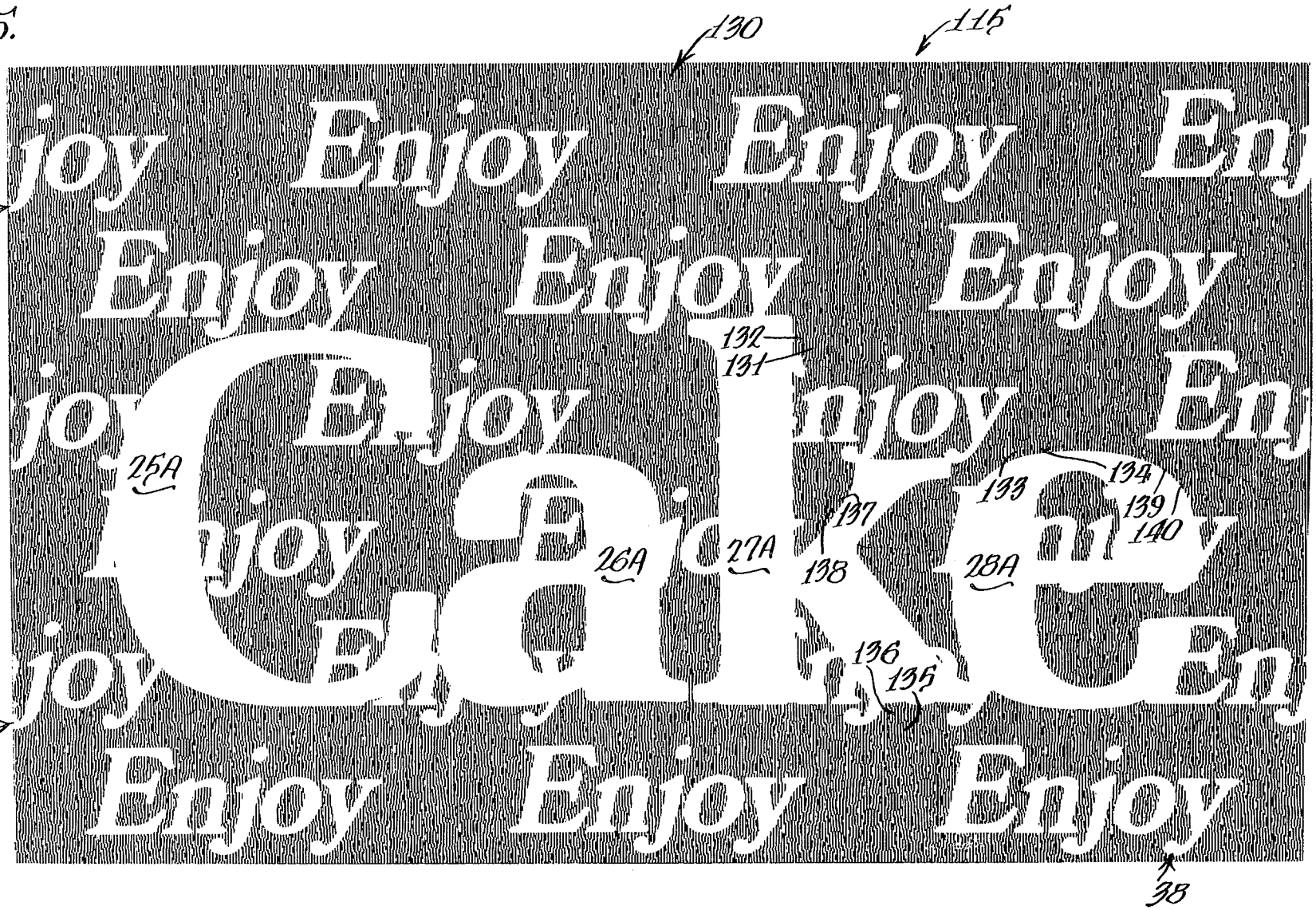
FIG. 5 is a front elevational view of a rear element for a second embodiment of the invention.

Referring now to FIG. 5, an alternative rear display element, indicated generally at 115, differs from the rear display element 15 only in the nature of the rear pattern, which is indicated generally at 130 in FIG. 5. The rear pattern 130 consists of a multiplicity of circles such as the circles 131 and 132 which are seen to be of different sizes, and in addition to the circles being of different sizes some of them may be tangent as are the circles 131 and 132, while others may be spaced as are the circles 133 and 134, while still others may be overlapping as are the circles 135 and 136. Each circle consists of contrasting strips such as the light strip 137 and the dark strip 138; and any spaces between the circles also have an all-over pattern of such strips. Further, like the rear pattern 30 of the first embodiment, the rear pattern 130 has some zones, such as the zone 139, in which the contrasting strips are vertical, and other zones, such as the zone 140, in which the contrasting strips are slightly inclined to the vertical.

Figure 6:
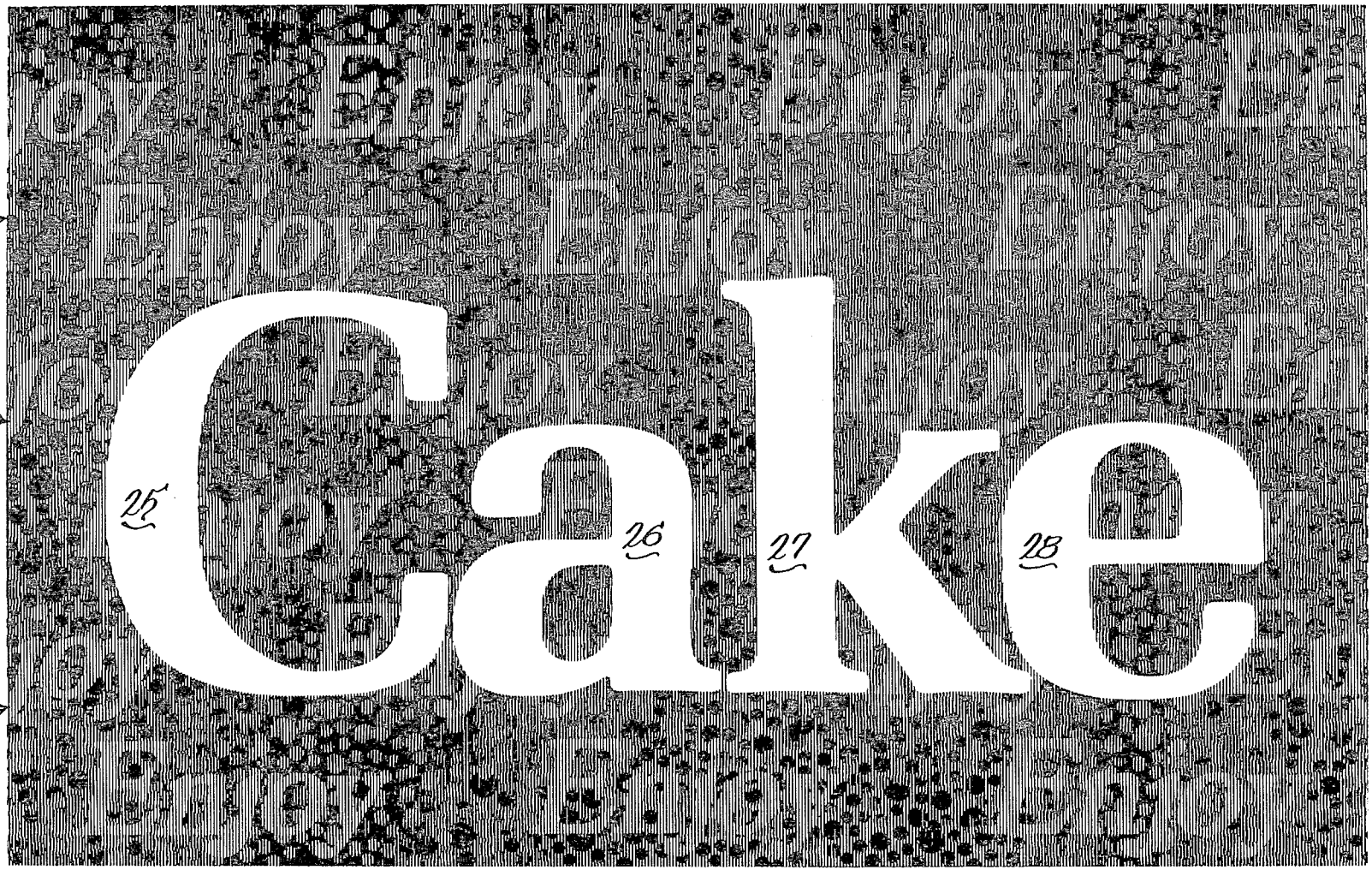
FIG. 6 is a view like FIG. 4 of the superimposed front and rear elements of said second embodiment of the invention.

FIG. 6 illustrates the appearance of the second embodiment of the invention when the rear element 115 is placed behind the front element 14. A field, indicated generally at 141, has a totally different visual appearance from the appearance of the field 39 in the first embodiment. In addition, when a viewer moves with respect to the second embodiment of the display device, the circles of the pattern 130 produce an impression like dancing bubbles of carbonation; and the circular zones such as the zone 140, which have their contrasting strips slightly inclined, appear to move vertically.

The front element 14 and the first and second embodiments 15 and 115 of the rear element are, of course, only exemplary of the types of patterns that may be employed. While the front pattern conveniently is like the simple front grid pattern 21, with all variations in the visual effect being produced by differences in the rear patterns, it is obvious that other types of front patterns may be used with other types of rear patterns to obtain an almost unlimited variety of different fields for various display devices.

The foregoing detailed description has been given for clearness of understanding only and no unnecessary limitations should be understood therefrom as modifications will be obvious to those skilled in the art.

I claim:

1. In a point of purchase advertising display device which has primary copy and secondary copy, each consisting of several characters, the improvement comprising, in combination:

a front element of substantial size which has a front fine pattern of transparent and opaque areas, and primary copy on said front element which is transparent or translucent and occupies only a small part of said element, said front pattern occupying substantially all of the front element except for what is occupied by said primary copy;

a rear element which has a rear fine pattern of visually contrasting areas which is dissimilar from said front fine pattern and which cooperates with said front pattern to produce a field, said field presenting changing visual effects when the front pattern occupies different positions relative to a line of sight from a viewer's eye to said rear pattern, said primary copy being repeated on said rear element effectively in register with said primary copy on the front element, and secondary copy on the rear element, all said copy on the rear element contrasting visually with said rear pattern and the margins of all the characters of said secondary copy being defined by the rear pattern and said secondary copy being visible through parts of said front pattern;

and means operatively associated with said front and rear elements to provide for a change in the position occupied by said front pattern relative to a line of sight from a viewer's eye to said rear pattern;

whereby the primary copy is very clearly defined in a changing field and the secondary copy is relatively obscure and the characters thereof appear to change shape as said field changes.

2. The combination of claim 1 in which the means operatively associated with the front and rear elements comprises means fixedly positioning said elements a predetermined distance apart, whereby movement of a viewer relative to the display device causes a change in the position occupied by the front pattern relative to a line of sight from said viewer's eye to the rear pattern.

3. The combination of claim 2 in which the front and rear elements comprise rigid transparent panels.

4. The combination of claim 3 in which at least one of said patterns is formed on a face of a panel.

5. The combination of claim 1 in which the front fine pattern consists of narrow, parallel vertical transparent and opaque strips of predetermined width extending from top to bottom of the front element.

6. The combination of claim 5 in which the rear fine pattern consists of a multiplicity of zones of small vertical and horizontal dimensions and each zone consists of narrow, visually contrasting strips which are of substantially said predetermined width, and which extend generally vertically.

7. The combination of claim 6 in which the zones are of essentially geometric shapes.

8. The combination of claim 7 in which the geometric shapes are rectangles of various sizes and shapes.

9. The combination of claim 7 in which the geometric shapes are circles of various diameters.

10. The combination of claim 7 or claim 8 or claim 9 in which at least some of the strips are slightly inclined to the vertical.

11. The combination of claim 2 in which said predetermined distance is from about eight to about thirty-two times the width of the transparent and opaque areas of the front fine pattern.

12. The combination of claim 1 in which the margins of all the characters in the primary copy on the front element and on the rear element are defined principally by said respective front and rear patterns.

13. The combination of claim 1 which includes illuminating means behind said rear element, in which the visually contrasting areas of the rear pattern are opaque and translucent, and in which the primary and secondary copy on the rear element is also translucent.

14. The combination of claim 13 in which the opaque areas of the front and rear patterns are colored, the translucent areas of the rear pattern and of the secondary copy are colored, and the primary copy contrasts visually with said colored areas.

15. The combination of claim 14 in which the primary copy is white.

* * * * *